US005299373A

United States Patent [19]

Breiner

[11] Patent Number: 5,299,373

[45] Date of Patent: Apr. 5, 1994

[54] HAND-GUN WITH MOVING CARTRIDGE CHAMBER MAGAZINE

[76] Inventor: Sandor Breiner, Szentendrei ut 12.I.2, Budapest, Hungary, H-1035

[21] Appl. No.: 887,910

[22] Filed: May 21, 1992

Related U.S. Application Data

[63] Continuation-in-part of Ser. No. 858,984, filed as PCT/HU90/CO78, Nov. 23, 1990, abandoned.

[30] Foreign Application Priority Data

Nov. 24, 1989 [HU] Hungary ..... 6161/89

[51] Int. Cl.[5] ..... F41A 9/20; F41A 9/23

[52] U.S. Cl. ..... 42/39.5; 42/15; 89/33.03

[58] Field of Search ..... 42/39.5, 7, 6, 15, 27, 42/69.01, 54; 89/9, 33.03, 155, 35.01; 102/281; 227/9-11

[56] References Cited

U.S. PATENT DOCUMENTS

| | | | |
|---|---|---|---|
| 168 | 4/1837 | Fisher et al. | 42/15 |
| 35,167 | 5/1862 | Maher | 89/9 |
| 52,248 | 1/1866 | Josselyn | 42/39.5 |
| 672,300 | 4/1901 | Turnbull | 42/39.5 |
| 2,057,169 | 10/1936 | Swenson | 89/33.03 |
| 2,856,716 | 10/1958 | Compton | 42/39.5 |
| 2,982,181 | 5/1961 | Panzica | 42/39.5 |
| 3,270,455 | 9/1966 | Smernoff et al. | 42/7 |
| 3,554,425 | 1/1971 | Oesterle | 227/10 |
| 3,670,942 | 6/1972 | Pomeroy | 227/10 |
| 4,063,672 | 12/1977 | Jochum | 227/10 |
| 4,266,357 | 5/1981 | Greenleaf | 42/1.15 |
| 4,760,834 | 8/1988 | Chevalier | 42/15 |

FOREIGN PATENT DOCUMENTS

| | | |
|---|---|---|
| 1056631 | 6/1979 | Canada . |
| 3123310A1 | 6/1981 | Fed. Rep. of Germany . |
| 3716009A1 | 5/1987 | Fed. Rep. of Germany . |
| 347965 | 3/1905 | France . |
| HU90/00078 | 11/1990 | PCT Int'l Appl. . |
| 789245 | 1/1958 | United Kingdom . |

*Primary Examiner*—David H. Brown
*Attorney, Agent, or Firm*—Beveridge, DeGrandi, Weilacher & Young

[57] ABSTRACT

The hand-gun comprises a grip (3), a barrel (1) connected to the grip, a movable cartridge chamber magazine (4) comprising at least two cartridge chambers (7) to receive cartridges, said magazine (4) being pushable into a slide (12) inside the grip (3), a magazine lifting device (6) for lifting the movable cartridge chamber magazine (4) chamber-by-chamber along the slide (12) inside the grip (3), and a trigger device. (FIG. 3 )

13 Claims, 2 Drawing Sheets

FIG. 1
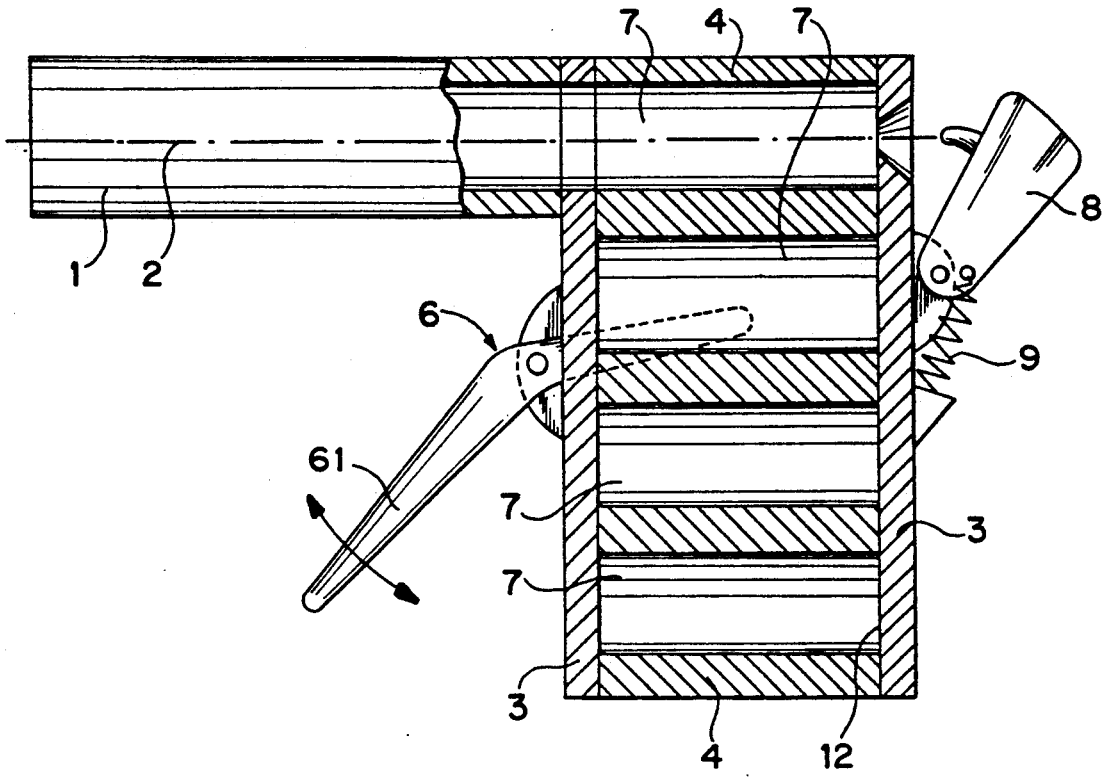
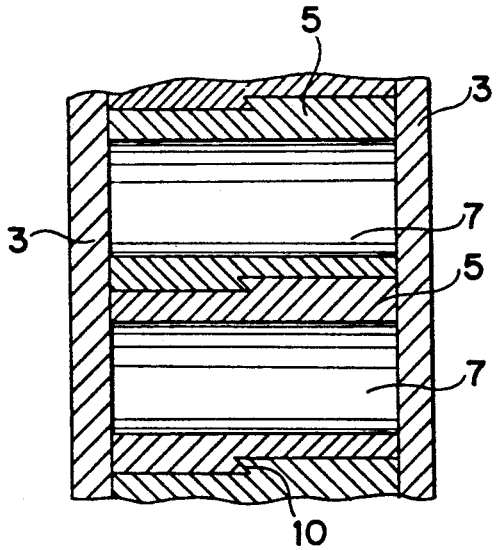
FIG. 2

HAND-GUN WITH MOVING CARTRIDGE CHAMBER MAGAZINE

This application is a continuation-in-part of International Patent Application PCT/HU90/00078 filed Nov. 23, 1990 which has been assigned U.S. Ser. No. 07/858,984, now abandoned.

FIELD OF THE INVENTION

The invention relates to hand-guns, in particular small-sized, pistol-like self-defense hand-guns with moving cartridge chamber magazine.

DESCRIPTION OF THE PRIOR ART

Hang-guns can basically be divided into two main groups of well known structures, namely to the revolving and the repeating, i.e. self-loading hand-guns. Irrespective of their caliber and muzzle energy, revolving hand-guns are always stiffly locked mechanisms, whereas the self-loading hand-guns may have stiffly locked structures or be locked by the mass force of a weight lock. Hand-gun is used here as a common name for pistols and revolvers. Locking means here the support of the bottom of the case in the moment of firing. In revolving magazine systems, the cartridges are stored in a cylindrical magazine comprising cartridge chamber and, in order to fire them, they are brought into the center line of the barrel by rotating the cylinder. The gun is divided in longitudinal direction into three parts, the barrel, the revolving magazine and the grip, thus these kind of weapons are relatively long. However, their structure is simple.

Self loading hand-guns, on the other hand, have only two main parts of longitudinal dimension, the barrel and the grip. The cartridges are stored in a magazine arranged in the grip. The cartridges are loaded into the center line of the barrel of the gun by means of spring force. Such kind of weapons have a forward and backward moving slide part which also provides reloading. Self-loading hand-guns are usually slimmer, shorter and they have more shots than the revolving magazine type hand-weapons, however, their structure is more complicated. While types of hand-guns are used by military and police personnel as service hand-weapon, among the small, so called self-defense pocket-guns the self-loading type is more common, due to its smaller size. The small size pocket-guns, like e.g. the types FN "Baby", Zbrojovka, Zetka "Duo" and other have a lengths of 100–120 mm, height of 70–90 mm, width of 20–25 mm, caliber of 6.35 mm, while their muzzle energy does not exceed 60 to 100 Nm and, in order to keep their size small, their locking mechanism is of the weight lock type.

It would be desirable to increase the caliber and muzzle energy of self-defense hand-(pocket)guns significantly, while retaining their small size. This is, however, with the presently known structures impossible.

SUMMARY OF THE INVENTION

The object of this invention is to increase the caliber of hand-guns up to even 11.4 mm, and their muzzle energy up to even 250 Nm, i.e. the usual dimension and muzzle energy of military and police service weapons, while retaining or even reducing the usual small size of the pocket-guns.

The hand-gun according to the invention comprises a grip, a barrel connected to the grip, a cartridge magazine comprising at least two cartridge chambers to receive cartridges, said magazine being pushable into a slide inside the grip, a magazine lifting device for lifting the magazine chamber by chamber along the slide inside the grip, and a trigger or firing mechanism. The essential difference between the invention and the prior art consists in the way of storing and loading of the ammunition into the cartridge chamber. According to the invention the ammunition is stored in a moving magazine which also comprises the cartridge chambers. The moving cartridge chamber magazine is arranged and guided within a slide inside the grip, so, that the cartridge chambers can be moved chamber by chamber straight towards the bore axis of the gun barrel by means of the magazine lifting device. After each shot, before effecting the next firing, the cartridge chambers with the loaded cartridges are lifted one "step" by means of the magazine lifting device actuated by the user, so that the next cartridge arrives at aligned position with the bore axis of the barrel. Thus the moving cartridge chamber magazine will be protruded by one height of chamber upwards from the grip after each shot.

Conveniently, the moving cartridge chamber magazine can be made as a single compact piece, or it may consist of as many independent elements joined together, as many cartridge chamber it contains. In the latter case the cartridge chamber magazine elements are provided with joints, e.g. dovetail joints, for fixing them together inside the grip, ensuring common movement of the cartridge chamber elements within the grip. Having come out from the grip after each lifting of the magazine, the top cartridge chamber element—carrying no ammunition—gets free from the rest of magazine elements and drops out of the grip.

BRIEF DESCRIPTION OF THE DRAWINGS

The invention will be described hereinafter with reference to the accompanying drawings, in which FIG. 1 shows the longitudinal section of a preferred embodiment of the hand-gun according to the invention FIG. 2 shows the longitudinal section of a part of the moving cartridge chamber magazine of a further embodiment.

DETAILED DESCRIPTION OF THE PREFERRED EMBODIMENTS

Figure 4:
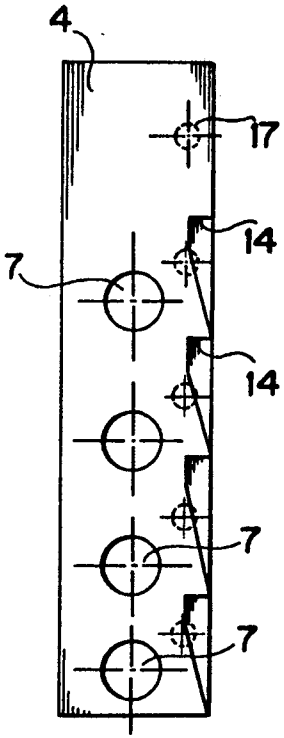
FIG. 4 is a front view of a preferred embodiment of the moving cartridge chamber.

In FIG. 1 a moving cartridge chamber magazine 4 comprising four cartridge chambers 7 is made as a single compact piece in which the cartridge chambers 7 are formed. The moving cartridge chamber magazine 4 is arranged and guided straight upwards in a slide 12 formed inside a grip 3. A gun barrel 1 and a magazine lifting device 6 are installed into the front part of the grip 3, while a firing device comprising spring 9 and hammer 8 is arranged at its rear end.

FIG. 2 shows another embodiment of the invention, wherein each cartridge chamber 7 is worked out as an independent cartridge chamber element 5, and the cartridge chamber elements 5 are joined together inside the grip 3 by means of loose/releasable surface-joints, e.g. by dovetail joints 10. The releasable joints are supported inside the grip by guiding supports of the slide 12. The joined elements 5 constitute a moving cartridge chamber magazine. The joints between adjacent cartridge chamber elements 5 can be released when at least one of the adjacent elements 5 is moved out from the grip 3.

The moving cartridge chamber magazine 4 with ammunition loaded into the cartridge chamber 7 should be inserted into the slide 12 of the grip 3. The moving cartridge chamber magazine 4 inserted into the grip 3 can be put into linear motion by means of a magazine lifting device 6, whereby the cartridge chamber 7 together with the loaded cartridge is positioned to be aligned with bore axis 2 of the gun barrel 1. In the aligned position of the chamber 7, the firing can be triggered by the firing device, i.e. hammer 8 prestressed by spring 9.

In order to make ready the gun for the next shot, the magazine lifting device 6 should be released into its home position and then, by pulling the trigger 61 of the magazine lifting device 6 towards the grip 3, the next cartridge chamber 7 can be lifted into firing position, aligned with the bore axis 2 of the barrel In this aligned (firing) position of the top cartridge the next shot can be fired off by means of the firing device 8, 9. In a preferred embodiment e.g. a ratchet-and-wheel type connection between the magazine lifting device 6 and the moving cartridge chamber magazine 4 may ensure that the magazine lifting device 6 provides upward movement, but by-passes in the opposite direction. Through every single operation of the magazine lifting device 6, the moving cartridge chamber magazine 4 is lifted outward of the grip 3 by height of one cartridge chamber 7 upwards.

The cartridge chamber elements 5 joined together by the dovetail joints 10 constituting a cartridge chamber magazine are moved by the magazine lifting device 6 as if they were a compact one-piece magazine. However, in course of subsequent shots, the cartridge chamber elements 5 which have come out of the grip 3 will fall off, since the guiding supports of the slide inside the grip 3 does not locate them anymore. Accordingly, in case of this latter embodiment not only the used cartridge (case) but also the corresponding cartridge chamber element will be discarded.

Figure 3:
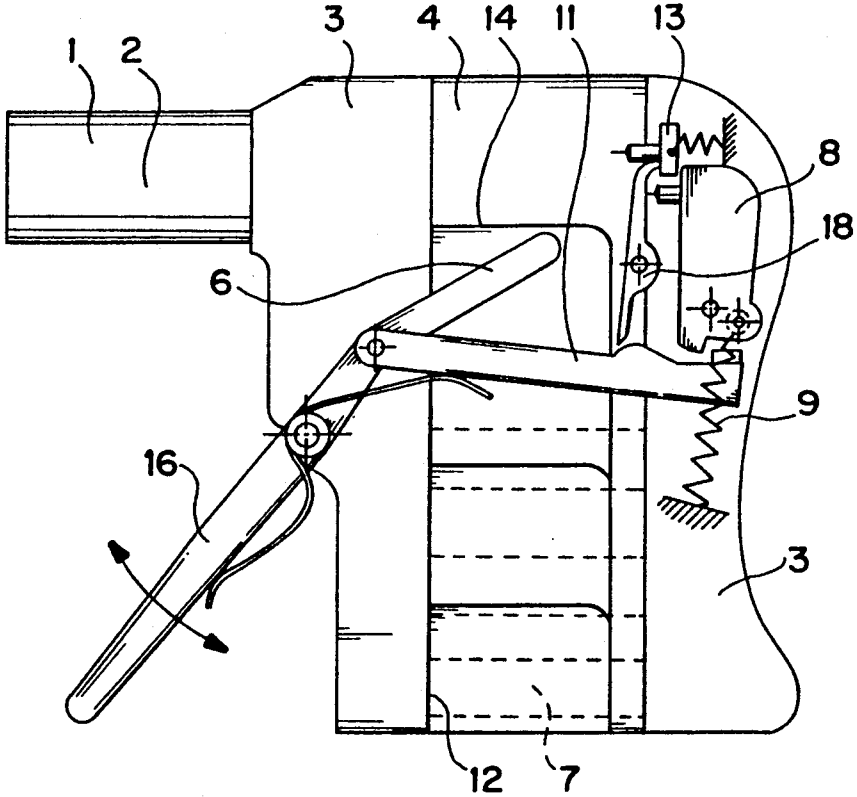
FIG. 3 is a side/sectional view of another preferred embodiment of the hand-gun according to the invention.

In the embodiment of FIG. 3 a trigger device operates the cartridge chamber magazine lifting device 6. The trigger device comprises a trigger 16, e.g. a double-armed lever, engaged with the lifting device 6, said trigger 16 being connected to the front end of an activating bar 11 the rear end of which is in operating connection with the hammer 8 prestressed by spring 9. The cartridge chamber magazine 4 is locked by a safety pin 13 penetrating into a safety pin hole 17 of the magazine 4 (see FIG. 4). Said safety pin 13 is operated by a releasing device 18. The releasing device 18 is also activated by the trigger 16 through said activating bar. The cartridge chamber magazine 4 is provided with lifting edges 14 for coacting with a lifting cog of the lifting device 6. The lifting edges 14 are formed on a side surface of the magazine, above each chamber.

The above apparatus operates as follows:

The cartridge chamber magazine 4 is pushed up into the grip 3 where it is locked by the safety pin 13 in a position shown in FIG. 3. At the moment of shooting the trigger 16 is pulled, the activating bar 11 moves the safety pin releasing device out from its locking position, at the same time the trigger 16 activates the lifting device 6 and when the cartridge chamber 7 with loaded cartridge arrives its aligned firing position, the hammer 8 activated by the trigger through said activating bar 11, effectuates firing. The moving cartridge chamber magazine moves upward chamber-by-chamber at each shot and comes out from the grip at the top.

An essential advantage of the invention, compared with other known structures, is that it combines the simple structure of hand-guns with cylindric cartridge chamber magazines and their simple principle of locking, with the disposition of the ammunition in the grip of the self-loading hand-guns, and due to this small, pocket-sized multishot hand-guns with the power of larger service hand-weapons can be realized. A further advantage is, that, due to the suggested simple structure, the manufacturing is easy, the costs of production are relatively low.

What is claimed is:

1. A hand-gun with moving cartridge chamber magazine, comprising a grip, a barrel connected to the front upper part of the grip, a cartridge magazine pushable into a slide inside the grip to receive cartridges, and a firing device at the rear part of the grip, characterized in that the cartridge magazine is a moving cartridge chamber magazine (4) comprising at least two cartridge chambers (7) joined rigidly together, and a magazine lifting device (6) connected to the grip (3), by means of which the cartridge chamber magazine (4) can be moved step-by-step upwards along the slide inside the grip (3).

2. A hand-gun as claimed in claim 1, characterized in that the moving cartridge chamber magazine is built up of individual cartridge chamber elements (5) joined rigidly together so that they can be moved along the slide inside the grip (3) as a single compact cartridge chamber magazine, each cartridge chamber element (5) comprising a single cartridge chamber (7).

3. A hand-gun as claimed is claim 2, characterized in that the adjacent cartridge chamber elements (5) are joined to each other by releasable surface joints, said joints being supported by guiding supports of the slide.

4. A hand-gun with movable cartridge chamber magazine comprising a grip;

a slide extending inside the grip and originating at an opening formed at one end of the grip;

a barrel connected to the grip;

a movable cartridge chamber magazine comprising at least two cartridge chambers to receive cartridges, said magazine being pushable through said opening into the slide formed in said grip;

a magazine lifting device for lifting the movable cartridge chamber magazine chamber-by-chamber along a straight line within the slide inside the grip; and a trigger device.

5. A hand-gun as claimed in claim 4 wherein said magazine lifting device is connected with the trigger device through an activating bar activated by the trigger.

6. A hand-gun as claimed in claim 4 wherein it is provided with a safety pin device coacting with the cartridge chamber magazine, said safety pin device being activated by the trigger device and/or by the magazine lifting device.

7. A hand-gun as claimed in claim 4 wherein said magazine lifting device comprises a lifting cog coacting with lifting edges of the magazine, said lifting edges being formed at the side surface of the magazine, each cartridge chamber having a lifting edge.

8. A hand-gun as claimed in claim 4 wherein said magazine lifting device is connected with the trigger device through an activating bar activated by the trigger.

9. A hand-gun as claimed in claim 4 wherein said magazine lifting device is connected with the trigger device.

10. A hand-gun as claimed in claim 4 wherein said magazine lifting device comprises a lifting cog coacting with lifting edges of the magazine, said lifting edges being formed at the side surface of the magazine, each cartridge chamber having a lifting edge.

11. A hand-gun as claimed in claim 4 wherein said magazine lifting device is connected with the trigger device through an activating bar activated by the trigger.

12. A hand-gun with movable cartridge chamber magazine comprising a grip;

a barrel connected to the grip;

a movable cartridge chamber magazine comprising at least two cartridge chambers to receive cartridges, said magazine being pushable into a slide inside the grip;

a magazine lifting device for lifting the movable cartridge chamber magazine chamber-by-chamber along the slide inside the grip; and a trigger device, and said magazine lifting device comprising a lifting cog coacting with lifting edges of the magazine, said lifting edges being formed at the side surface of the magazine, and each cartridge chamber having a lifting edge.

13. A hand-gun with movable cartridge chamber magazine comprising a grip;

a barrel connected to the grip;

a movable cartridge chamber magazine comprising at least two cartridge chambers to receive cartridges, said magazine being pushable into a slide inside the grip;

a magazine lifting device for lifting the movable cartridge chamber magazine chamber-by-chamber along the slide inside the grip; and a trigger device, and said magazine lifting device being connected with the trigger device through an activating bar activated by the trigger.

* * * * *